US006608987B2

(12) United States Patent
Bartscher et al.

(10) Patent No.: US 6,608,987 B2
(45) Date of Patent: Aug. 19, 2003

(54) METHOD AND MACHINE FOR PRINTING AND/OR COATING OF A SUBSTRATE WITH A UV CURABLE TONER

(75) Inventors: Gerhard Bartscher, Köln (DE); Domingo Rohde, Kiel (DE); Detlef Schulze-Hagenest, Molfsee (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/023,955

(22) Filed: Dec. 18, 2001

(65) Prior Publication Data

US 2002/0090238 A1 Jul. 11, 2002

(30) Foreign Application Priority Data

Dec. 22, 2000 (DE) ..... 100 64 552

(51) Int. Cl.[7] ..... G03G 15/20; G03G 13/20
(52) U.S. Cl. ..... 399/336; 399/69; 430/124
(58) Field of Search ..... 399/320, 321, 399/328, 335, 336, 341, 67, 69; 430/124

(56) References Cited

U.S. PATENT DOCUMENTS 4,511,778 A * 4/1985 Takahashi et al. ..... 399/336
5,805,969 A 9/1998 Elsemans et al.
5,970,301 A 10/1999 DeCock
6,101,345 A 8/2000 VanGoethem et al.
6,120,960 A * 9/2000 Aoki et al. ..... 430/124
6,461,782 B1 * 10/2002 Sasada et al. ..... 430/124
6,535,711 B2 * 3/2003 Rohde et al. ..... 399/306

FOREIGN PATENT DOCUMENTS

DE 198 57 229 A1 1/1999
DE 199 54 953 A1 5/2000
JP 2000-221821 A * 8/2000

* cited by examiner

*Primary Examiner*—Joan Pendegrass
(74) *Attorney, Agent, or Firm*—Lawrence P. Kessler

(57) ABSTRACT

A machine for application and fixation of curable toner through a substrate and a method for printing and/or coating a substrate, especially paper or cardboard. The method includes the use of at least one curable toner in which at least one toner layer or at least one image having a toner layer is transferred to the substrate and fixed on it, the toner being a UV curable toner having at least one polymer that is exposed to UV (ultraviolet) radiation for crosslinking of its polymer chain. The degree of melting of the toner layer being fixed being controlled as a function of the desired luster.

15 Claims, 1 Drawing Sheet

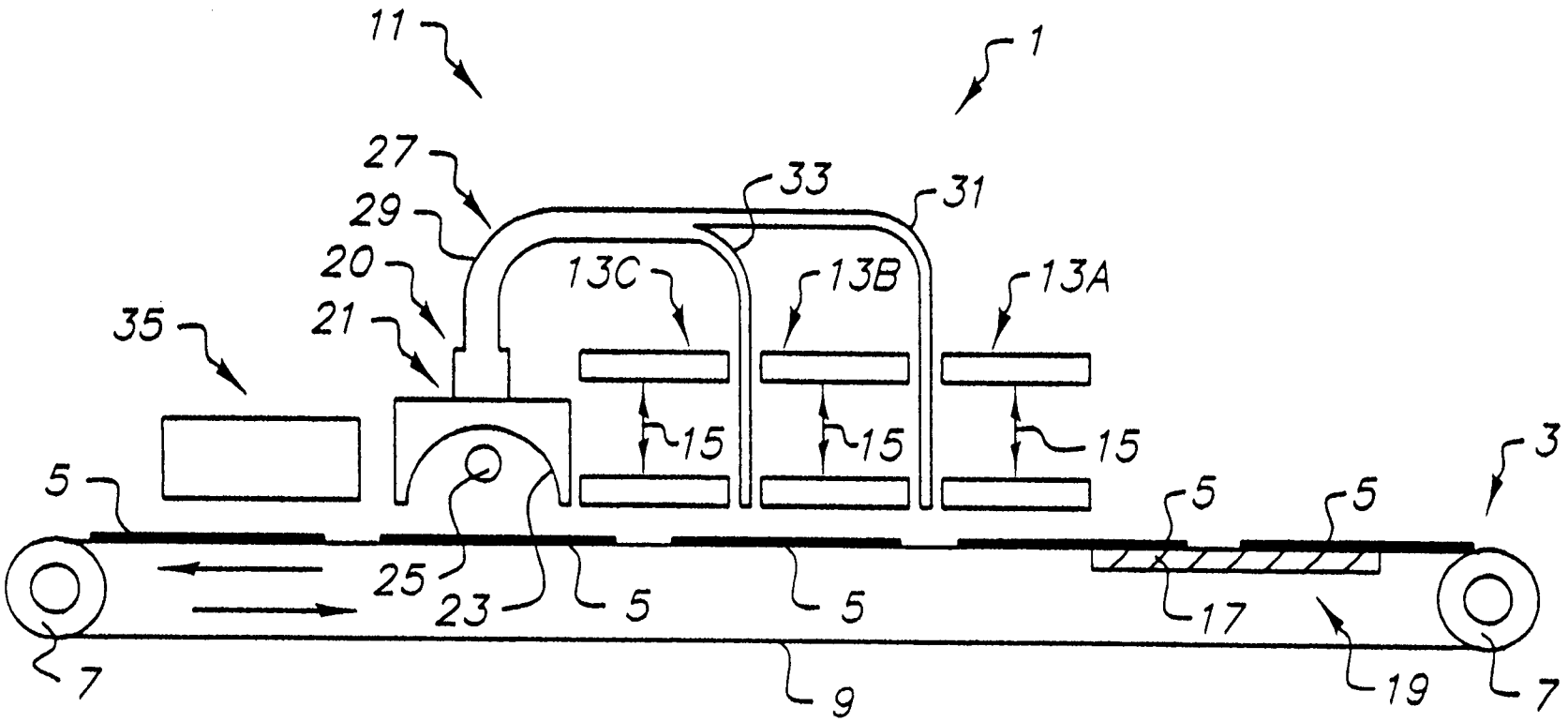
1
11
27
29
20
21
35
31
33
13A
13B
13C
15
15
15
5
5
5
5
5
3
7
7
9
17
19
23
25

METHOD AND MACHINE FOR PRINTING AND/OR COATING OF A SUBSTRATE WITH A UV CURABLE TONER

FIELD OF THE INVENTION

The invention concerns a method for printing and/or coating of a substrate, especially paper or cardboard using at least one meltable, curing toner and a machine for application and fixation of curable toner onto a substrate.

BACKGROUND OF THE INVENTION

A known printing and/or coating method is electrostatic printing in which a latent electrostatic image is developed by charged toner particles. These are transferred to an image-receiving substrate, hereafter substrate for short. The developed image transferred to the substrate is then fixed, the toner particles being heated and melted and the substrate optionally heated. Contact methods are frequently used to melt the toner particles, in which the toner particles are brought into contact with the corresponding devices, for example, hot rolls or rollers. The shortcoming here is that the design, maintenance and operating costs of these contact-heating devices are demanding and therefore cost-intensive. Consequently, the use of silicone oil as parting agent is necessary, which is supposed to prevent adhesion of the melted toner to the heating device. The error rate caused by the contact heating devices is also relatively high.

For fixation of toner transferred to paper, for example, contactless heating devices and methods are also known in which the toner particles are melted, for example, with heat/microwave radiation or hot air so that they adhere to the paper.

In the printing and copying methods in which the image applied to the substrate or the coating is developed by toner, the luster of the toner does not follow the luster of the paper, as in offset printing. This is true both for noncontact and contact toner fixation methods. The reason for this is the greater layer thickness of the toner relative to the color layers produced in offset printing methods. The relatively thick toner layers fill up the porosity of the paper so that a smooth surface structure and a certain luster of the toner layer are produced. After the toner is fixed on the paper, the luster of the toner layer can subsequently be increased by calender having hot rolls.

A shortcoming in the known method is that the luster of the toner layers after fixation on the paper differs as a function of the thickness of the toner layers so that after actual fixation of the toner subsequent treatment of the printed or coated paper, for example, with calenders is required in order to obtain an equally high luster even with different toner layer thicknesses.

SUMMARY OF THE INVENTION

The task of the invention is to offer a process in which control of the luster of the toner or coating applied to the substrate is possible largely independent of the luster of the substrate consisting of paper or cardboard. Another task consists of the fact that the method is to be used in particular for contactless toner melting methods. Another objective is improvement of the printing or copying quality, especially the quality of toner melting during fixation, especially cohesion of the toner layer. Finally, an objective of the invention is to keep heating of the substrate as low as possible in order to minimize moisture elimination from the substrate. Consequently, a machine for execution of the method is offered.

To solve the task, a method is proposed to print or coat the substrate, for example, a paper sheet or paper web in which at least one curable toner is used. The liquid or dry toner has at least one polymer and colored pigments as well as additional ingredients which will be taken up further below. In conjunction with the present invention, "curing" of the toner is understood to mean that this toner is heated to or above its glass transition point so that the toner particles melt. Exposure of the melted toner to UV radiation causes the polymer chains to crosslink and therefore become longer so that the glass transition point and viscosity of the toner become greater. These changes in properties mean that the toner no longer flows on the substrate from a certain chain length but instead exhibits rubber-like properties. This crosslinking of the toner materials is called curing. Melting and curing of the toner or toner layer(s), as described above, is referred to for short as fixation of the toner.

The method according to the invention is characterized by the fact that the degree of melting of at least one toner layer being fixed is controlled as a function of the desired luster of a fixed toner image. The toner is therefore only melted until the toner layer(s) situated on the substrate has a specific surface roughness or porosity at which a specific luster of the toner is produced. In order to almost freeze in the state of the heated toner melted and made flowable to the desired degree at which a desired luster is produced, an appropriate method is used as a function of the properties of the corresponding toner. To achieve high luster of the fixed toner layer, it is fully melted so that it can flow, through which it acquires a very even surface structure and therefore high luster. If a dull toner layer with low luster is to be produced, the toner according to the invention is not fully melted so that toner particles having a certain geometric shape are still situated in the melt so that the surface of the toner layer as corresponding unevenness or roughness and therefore a limited luster. This state of the melt is then frozen in with an appropriate method. The method according to the invention therefore presents, by appropriate control of the process parameters during fixation, among other things, duration and/or intensity of heating of the solvent, a rapid and reliable adjustment of the toner image luster in advantageous fashion without the requirement for this purpose, as in the known prior art methods, processing or final processing of the toner fixed on the substrate in a technical device expressly prescribed for this purpose, for example, a calender.

In a particularly preferred variant, a toner having at least one polymer is used which cures by exposure to ultraviolet rays, hereafter referred to as UV radiation for short, which means that its polymer chains begin to crosslink on exposure to UV radiation. Because of this property, a variant of the method according to the invention is obtained in which the toner layer being fixed is heated to its glass transition point or above it and exposed to UV radiation. Exposure to ultraviolet light, as mentioned, leads to crosslinking of the polymer chain and to an increase in toner viscosity so that the melted toner after a certain degree of crosslinking can no longer flow. The surface structure of the toner image and therefore its luster can then no longer change. Exposure of the toner layer with UV radiation for the purpose of crosslinking can occur already during the melting process or after conclusion of the melting process.

The highest degree of melting of the toner is preferably 100%, i.e., the toner layer(s) is heated to a high enough temperature and held sufficiently long at this temperature so that the toner layer(s) consisting of toner particles is melted and made flowable so that an even layer is formed on the surface of the substrate. The highest possible luster is achieved because of this. At a low degree of melting, i.e., at a degree of melting of 60%, in which the toner is already partially melted and made flowable, toner particles are still present in the melt, which have still not fully lost their shape in favor of a melt continuum and the toner layer therefore still exhibits a certain unevenness in roughness so that the luster that is produced is correspondingly lower than in a fully melted and flowing toner layer. By influencing the degree of melting in combination with corresponding initiation of the crosslinking/curing process, any arbitrary luster value (within certain tolerances) can be produced under practical conditions between dull and highly lustrous.

In the variants of the method according to the invention in which UV-curing toner is used, melting of the toner and crosslinking of the toner material are two process steps whose process parameters are adjustable independently of each other. At least two independently controllable devices are therefore required in order to influence one process step independently of the other. For example, a contactless heating device is used to melt the toner with which the toner being fixed can be exposed to electromagnetic radiation. The crosslinking of the toner material in order to freeze in the heated toner exhibiting a specific degree of melting, a curing device is preferably used that has a UV radiation source. The devices that should operate independently of each other are preferably coupled with a common control.

In a preferred variant, a powdered dry toner is used whose glass transition point preferably lies in a range from 45 to 75° C. and whose glass transition point shifts by about 10 to 20° C. after first heating of the toner above its original glass transition point with subsequent cooling of the toner, so that the lower value of its new glass transition point lies in the range from 55 to 65° C. A dry toner that crosslinks, preferably exclusively by exposure to ultraviolet light, is particularly preferred whose glass transition point before first melting lies at 45° C. or above and has, for example, the following components:

1. Uralac XP 3125 (polyester resin) with about 83 parts by weight (79.05% toner total weight), 2. Uralac ZW 3307 (crosslinking agent) with about 17 parts by weight (16.19% of toner total weight), 3. Irgacure 184 (photoinitiator) with about 1 part by weight (0.95% of toner total weight), and 4. BASF Heliogen Blue 7090 (color pigment) with about 4 parts by weight (3.81% of toner total weight).

Additives to control melt flow, surface quality, powder charging, powder flow, etc. are optionally used. To achieve other color impressions, other color pigments or dyes can also be used.

Melting of the toner for the purpose of fixation on a substrate occurs at a certain temperature of about 70 to 120° C. at which curing of the toner is also carried out as a result of crosslinking of the polymer chains during exposure of the melted toner to ultraviolet light. By crosslinking of the polymer chain, the glass transition point of the toner increases by more than 10° C. and so does its viscosity in the molten state. The toner particles preferably have an average particle size of about 4 $\mu$m to 10 $\mu$m. With reference to the composition of the toner and the implementable fixation method, the publication "UV cured toners for printing and coating on paper-like substrates" of Detlef Schulze-Hagenest and Paul H. G. Binda, IS&T 13$^{th}$ International Congress Advances in Non-Impact Printing Technologies, 1977, is referred to.

In a preferred variant of the method, melting of the toner layer(s) transfer of the substrate occurs contactless, for example, by infrared and/or microwave radiation and/or hot air. It is also proposed that the duration and/or intensity of the heat energy applied to the toner layer being fixed is adjusted as a function of the desired luster. The luster of the toner fixed on the substrate can be advantageously controlled by controlling energy supplied during the melting process and/or the time between the start of the melting process and the beginning of curing with the surface topology of the toner layer, which means it can adjusted to a desired value. By influencing this process parameter, a desired luster can be set with high accuracy, which can be varied, for example, from substrate to substrate or from printing run to printing run. Consequently, the luster during a printing run can be varied from one substrate to the next substrate. Each printed substrate can therefore exhibit a different luster.

The method according to the invention easily permits implementation of a control loop to adjust the desired luster; the luster of a toner layer fixed on the substrate or toner image after the fixation process is checked and, if an unduly large deviation of the measured luster actual value from the luster reference values present, automatic adjustment of the parameter of the fixation process is carried out in order to reduce the difference between the reference and actual luster values. Higher luster is achieved by intensifying the melting process or by reducing the UV radiation coupled into the melting process. Lower luster is achieved by the opposite procedure, i.e., by a less intense melting process and/or intensification of UV exposure.

A variant of the method is also preferred in which the effect that the electromagnetic radiation of a UV radiation source used to cure the toner has on the degree of melting of the toner, is considered during control of this toner fixation process to adjust a desired luster. It has been found that the UV radiation is absorbed not only by the photoinitiator of the UV curable toner, but also by other components of the toner, like the polymer and color pigments, which influences the melting process of the toner, just as the electromagnetic radiation of the heating device for melting of the toner does, for example, the infrared radiation of a hot UV radiation source. This must be considered during fine adjustment of the fixation process, i.e., the process parameters of the melting and curing process are adjusted accordingly to it. A variant of the invention in which the employed toner has a sharp phase transition of solid to liquid is also preferred. The temperature of the substrate at which the desired fixation of the toner on the substrate can be guaranteed can therefore be maintained relatively precisely so that excess heating of the substrate can be avoided. Because of this, moisture escape from the sheet and/or web is accordingly limited, especially in a paper or cardboard web or a paper or cardboard sheet.

Finally, a variant of the method characterized by the fact that the toner has at least one polymer and that the polymer has a smaller molecular weight distribution than a polymer used in a contact fixation method, especially during melting of the toner by hot rolls, is preferred. In the known contact fixation method, the toner polymer transferred to the substrate exhibits very good adhesion to the substrate, but the toner is brittle, which leads to cracking during folding of the substrate, especially in high-density toner layers. Cracks in the toner lead to unprinted or uncoated line regions on the substrate after it is unfolded again. In the method according to the invention, cracking is preferably fully but at least largely avoided by a combination of contactless melting and curing of the toner by UV radiation.

In a preferred variant up to seven toners with different colors can be transferred and fixed to produce the image or coating on the substrate. However, either only one toner (for example, black-white printing) or only four different toners with different colors (multicolor printing), for example, the base colors, are preferably applied. It is emphasized that in conjunction with the present invention, the term "coating" is understood to mean a thin layer formed by at least one toner. A coating can therefore easily be colorless or have several toners of different color.

In another variant of the method, a thermally crosslinking toner having at least one polymer is used. The polymer chains of this type of toner begin to crosslink automatically when the toner is heated to or above its glass transition point. An additional effect on the toner so that its polymer chains are crosslinked, for example, exposure to UV radiation in a UV-curing toner, is not essential here. Crosslinking of the polymer chain even in the thermally crosslinking toners, as in the UV-curing toners, also leads to an increase in glass transition point and an increase in viscosity so that it acquires a thermoplastic, rubber-like structure with increasing crosslinking and can no longer flow. Control of the luster occurs in a thermally crosslinking toner according to the invention via the heating profile of the toner. It has been shown that slow heating leads to an even and therefore lustrous surface structure of the toner, whereas rapid and short heating leads to relatively uneven and therefore a dull surface.

In a preferred variant, the method according to the invention can be used in conjunction with or as a component of a digital printer or copier, i.e., a machine that operates according to the electrographic or electrophotographic process. The method in principle can be used anywhere a substrate is coated with at least one toner or a toner image is transferred to a substrate and fixed there.

A machine, especially an electrographic or electrophotographic printer or copier is proposed to solve the task for application and fixation of curable toner through substrate, especially paper or cardboard, having a preferably contactless heating device, like an infrared radiator for melting of the toner transferred to the substrate. At least one curing device is also provided that serves to cure the toner and expose it to UV radiation, if the toner is a UV-curable toner. The machine according to the invention also has a control device to adjust a desired luster of the toner transfer to the substrate, in which the control device determines the process parameters of the heating device and/or curing device to control the melting and curing process, i.e., the toner fixation process. "Process parameters" are understood to mean, among other, the duration of melting and the intensity of the heat supplied to the toner being fixed and the time and duration of exposure of the at least partially melted toner layers to ultraviolet light. A control device preferably can permit automatic printing, copying and/or coating of the substrate, the luster of the fixed toner layer being variable from dull to extremely lustrous. A desired luster is advantageously adjusted here exclusively by influencing the melting and curing process of the toner. Additional devices, like a calender, are not necessary. The machine is characterized by a simple design and high functionality in terms of adjustment of the desired luster of the coating or toner image applied to the substrate.

To solve the task, a machine is proposed having at least one heating device for fixation, i.e., melting and curing, of the toner applied to the substrate and a control device to adjust the desired toner image luster. By a control device, the heating profile of the toner is adjusted during the fixation process by controlling the process parameters of the heating device. A thermally crosslinking toner is therefore used here in which during heating to or above its glass transition point its polymer chains independently begin to crosslink. "Process parameters" of the heating device are understood here to mean, among other things, the energy applied to the toner layer being fixed, the duration, how long the toner layer is held at a certain temperature that lies at or above the glass transition point of the toner. The machine according to the invention permits adjustment of the luster of the toner layer being fixed by deliberate influencing of the melting process. Additional devices can produce a desired luster, for example, a calender, or a curing device, as is required in a UV-curing toner, can be dispensed with here.

The invention, and its objects and advantages, will become more apparent in the detailed description of the preferred embodiment presented below.

BRIEF DESCRIPTION OF THE DRAWINGS

The invention is further explained below by a single FIGURE.

The FIGURE schematically depicts a section of a practical example of machine 1 for printing and/or coating of substrates.

DETAILED DESCRIPTION OF THE INVENTION

For the purpose of this invention, a latent electrostatic image or coating of a surface region or the entire substrate surface is developed by charged toner particles. It is assumed purely as an example below that the substrates are paper sheets and the employed toner is a UV-curable toner and the toner image is fixed on the substrate.

Machine 1 comprises a transport device 3 to transport the paper sheet 5 from right to left according to the FIGURE. The transport device 3 has at least two deflection rolls 7 over which at least one endless drivable conveyor belt 9 is guided. The paper sheets 5 are placed on the upper section of the conveyor belt and spaced from each other in the direction of transport. The paper sheets 5 are conveyed passed the fixation station 11 by conveyor device 3.

Fixation station 11 has contactless heating devices 13A, 13B and 13C that are arranged at a spacing from each other viewed in the transport direction of paper sheet 5 and extend across the width of paper sheet 5. The heating devices 13A to 13C are used to melt the toner image transferred to the paper sheet in a preceding working station. The heating devices 13A to 13C are preferably moveable independently of each other and stepless in the direction toward conveyor belt 9 and in the opposite direction, as indicated with a double arrow 15. The heating devices 13A to 13C are each shown in the FIGURE in two positions relative to conveyor belt 9. By adjusting a corresponding spacing of the heating devices to conveyor belt 9, the intensity of the heat impinging on the toner image can be influenced. The heating devices 13 permit melting of the toner transferred to the paper sheet by infrared light and/or microwaves, hot air or the like. The heating devices can preferably be engaged and disengaged separately from each other. Consequently, the level of energy emitted by the heating devices is adjustable separately from each other. Because of this configuration, it is easily possible for the toner image to initially be preheated with the first heating device 13A and only then melted by the second and third heating devices 13B and 13C. It remains to be stated that the flow behavior of the toner situated on paper sheet 5 can be deliberately influenced by the heating devices 13A to 13C that operate independently of each other.

To move the heating devices 13A to 13B into a position close to the substrate and far from the substrate and into almost any arbitrary intermediate position, an adjustment device (not shown in the FIGURE) is provided in which the adjustment devices can be operated independently of each other. The spacing of the corresponding heating device from the toner being fixed on the substrate is adjusted as a function of the heating profile of the toner. To vary the melting conditions, engagement and disengagement of individual heating devices is additionally possible.

Before the paper sheets 5 are guided into fixation station 11 and transported past the heating devices 13A to 13C, preheating of the paper sheet having a toner image is provided in this practical example. For this purpose, a preheating device 19 formed via heating plate 17 is used. The heating plate 17 is situated within the conveyor belt loop and allocated to the upper conveyor belt section. The heating plate 17 heats the conveyor belt 9 and therefore the paper sheet positioned on the opposite side; the heating plate 17 therefore does not come into direct contact with paper sheet 5.

Fixation station 11 also has a curing device 20 with a UV radiation source 21 having at least one UV lamp 25 enclosed by a reflector 23. The reflector 23 has an opening toward the conveyor belt 9 through which open ultraviolet rays can be emitted directly onto the paper sheet 5 opposite the UV lamp. As an alternative, an electron beam can be used to cure the toner instead of the UV radiation source 21. As is apparent from the FIGURE, the UV radiation source 21 is connected after the last heating device 13C in a transport direction of paper sheet 5.

A light guide device 27 is also provided, coupled to the UV radiation source 21. The light guide device 27 serves to guide the UV rays of UV lamp 25 in the melting region opposite the sheet transport direction. The light guide device 27 has a main light channel 29 open on one end to the UV lamp 25, which grades into a first secondary light channel 31 and a second secondary light channel 33 on its other end. The open end of the secondary light channel 31, 33 lies here at the same, invariable spacing relative to the upper conveyor belt section on which the paper sheets 5 lie.

The first secondary light channel 31 is arranged in the region between the first heating device 13A and the second heating device 13B, whereas the second secondary light channel 33 is arranged in the region between the second heating device 13B and the third heating device 13C. This configuration of radiation source 21, light guide device 27 and heating devices 13A to 13C permits simultaneous melting and curing of the toner image to be fixed on paper sheet 5.

The UV rays applied for paper sheet 5 by UV radiation source 21 can be emitted as continuous light or in the form of light flashes that can lie in a time range from 0.1 ms to 10 ms. A cooling station 35 is connected after UV radiation source 21, which is used to cool the paper sheets 5 before they leave the fixation station 11.

In order to obtain a dull surface state of the toner image situated on the paper sheet, it can easily be sufficient to use only a single heating device 13. The curing process of the toner begins at the moment when the toner is heated far enough so that it begins to become soft and its molecules possess adequate mobility. The variant of machine 1 described with reference to the FIGURE in which several heating devices 13A to 13C are provided, is preferably used only in cases when very high luster is to be achieved.

To control the melting and curing process, machine 1 also has a control device (not shown) so that it establishes the process parameters of at least one heating device 13 to adjust a certain luster of the toner being fixed on the paper sheet, i.e., its radiation power and/or spacing to the paper sheet and/or the at least one UV radiation source and executes the adjustments preferably automatically.

The method according to the invention is readily apparent from the description of the FIGURE. This is characterized by the fact that the at least one toner layer transferred to the paper sheet is not fully melted in each case but that the degree of melting of the toner layer is controlled in defined fashion to adjust the desired luster. In this case, it applies that the greater the degree of melting, the greater the luster of the toner layer. In other words, if only limited luster, i.e., a dull surface is to be produced, the toner layer is only just melted. After a specific degree of melting of the toner layer being fixed is achieved by deliberate heating, this state of the toner layer is frozen in by exposure to UV rays. The UV rays cause crosslinking of the polymer chains in the melted toner particles, which become longer because of this and this leads to higher viscosity of the toner. From a certain viscosity, the toner is so viscous that it no longer flows and its structure therefore no longer changes. Crosslinking can occur in parallel with melting or afterward.

Concerning the practical example of the machine described with reference to the FIGURE, it is further stated that the toner is heated by the first heating device 13A to or above its glass transition point and by introduction of UV radiation via the first secondary light channel 31 into the melting region, the polymer chains have already begun to melt and crosslink before the toner image is transported into the area of effect of the downline second heating device 13B. Because of crosslinking of the polymer chains, the viscosity of the toner increases drastically as a function of composition. Crosslinking of the polymer chain can be continued until the toner can no longer be liquefied by the following heating devices 13B and 13C. In this case the luster of the toner image is therefore determined exclusively by melting in the region of the heating device 13A and exposure of the melted toner in the desired fashion with ultraviolet radiation via the first secondary light channel 31. The downline heating devices 13B and 13C then only serve to keep the toner in a thermoplastic region so that it is rigidly bonded to paper sheet 5. It is apparent that, if desired, the heating devices 13B and 13C and the light guide device for fixation of the toner can be dispensed with. In its simplest version the machine 1 according to the invention therefore has only one heating device and one curing device 20 which can be designed separately from each other or as a compact assembly.

To summarize, it remains to be stated that the toner fixation process according to the invention is characterized in particular by the fact that a desired surface quality of the toner that determines the luster is adjustable by deliberate influencing of the melting process of the toner and that mechanical final treatment of the fixed toner image to achieve a specific luster is therefore not required.

The practical examples are not to be understood as a restriction of the invention. In the context of the present disclosure, numerous modifications are instead possible, especially those variants, elements and combinations and/or materials that combination or modification of individual features described in the general description and variants as well as Claim and contained in the drawing, or elements or process steps can be deduced by one skilled in the art for solution of the task and lead to a new object or to new process steps or process step sequences by combinable features.

The invention has been described in detail with particular reference to certain preferred embodiments thereof, but it will be understood that variations and modifications can be effected within the spirit and scope of the invention.

What is claimed is:

1. Method for printing and/or coating of a substrate, especially paper or cardboard, using at least one curable coating, comprising:

at least one toner layer or an image having at least one toner layer is transferred to the substrate and fixed on it, the toner being a UV curable toner having at least one polymer that is exposed to UV (ultraviolet) radiation for crosslinking of its polymer chain, the degree of melting of the toner layer being fixed being controlled as a function of the desired luster.

2. Method according to claim 1, characterized by the melting of the toner and crosslinking of the toner materials being two process steps and that melting and crosslinking are controlled independently of each other.

3. Method according to claim 1, characterized by the toner being exposed to UV radiation during and/or after melting of the toner.

4. Method according to claim 1, characterized by the time when the toner layer heated above the glass transition point is exposed to UV radiation that contributes to polymer chain crosslinking being selected as a function of the desired luster.

5. Method according to claim 1, characterized by melting of the toner layer occurring contactless, and the time and/or intensity of the heat applied to melt the toner layer being adjusted as a function of the desired luster.

6. Method according to claim 1, characterized by the affect that electromagnetic radiation of a UV radiation source used to cure the toner has on the degree of melting of the toner is considered during control of the toner fixation process to adjust the desired luster.

7. Method according to claim 1, characterized by the employed toner having a sharp phase transition from solid to liquid.

8. Method according to claim 1, characterized by the toner having at least one polymer being a thermally crosslinking toner and the control of the luster occurring by the heating profile of the toner during the fixation process.

9. Machine (1), especially digital printer, for application and fixation of a curable toner to a substrate (5), especially paper or cardboard, comprising:

at least one heating device (13A, 13B, 13C) for melting of the toner transferred to substrate (5), at least one curing device (20) to cure the toner, and a control device to adjust the desired luster, in which the control device adjusts the process parameters of the heating device (13A, 13B, 13C) and/or the curing device (20) for the melting and curing process.

10. Machine according to claim 9, wherein said curing device (20) has at least one radiation device to emit electromagnetic radiation, especially UV radiation source (21).

11. Machine according to claim 9, wherein said curing device (20) being connected after the heating device (13A, 13B, 13C) in the direction of transport of the substrate.

12. Machine according to claim 9, wherein a light guide device (27) is provided to introduce the electromagnetic radiation of the radiation device into the effect region of the heating device (13A, 13B, 13C).

13. Machine according to claim 9, wherein said heating device (13A, 13B, 13C) being moveable by an adjustment device in a direction toward the toner being fixed transferred to the substrate and in the opposite direction.

14. Machine according to claim 9, wherein several heating devices (13A, 13B, 13C) being provided that can be engaged and disengaged separately from each other and/or can be moved in the direction toward the toner being fixed and in the opposite direction.

15. Machine according to claim 9, wherein the heating device heating the substrates preferably being paper, by microwave radiation.

* * * * *